United States Patent [19]

Chen et al.

[11] Patent Number: 4,978,839

[45] Date of Patent: Dec. 18, 1990

[54] POSTAGE METER VALUE CARD SYSTEM

[75] Inventors: Robert K. T. Chen, Wilton; Winslow E. Jackson, Monroe; Paul H. K. Kim, Wilton, all of Conn.

[73] Assignee: Pitney Bowes Inc., Stamford, Conn.

[21] Appl. No.: 423,689

[22] Filed: Oct. 18, 1989

Related U.S. Application Data

[63] Continuation of Ser. No. 153,398, Feb. 8, 1988, abandoned.

[51] Int. Cl.[5] ..... C06K 15/20

[52] U.S. Cl. ..... 235/375; 235/383; 235/492

[58] Field of Search ..... 235/375, 380, 383, 464.02

[56] References Cited

U.S. PATENT DOCUMENTS

| | | | |
|---|---|---|---|
| 4,218,011 | 8/1980 | Simjian | 235/375 |
| 4,268,817 | 5/1981 | Simjian | 235/375 |
| 4,629,871 | 12/1986 | Scribner | 235/375 |
| 4,802,218 | 1/1989 | Wright | 235/370 X |

FOREIGN PATENT DOCUMENTS

| | | | |
|---|---|---|---|
| 0207492 | 1/1987 | European Pat. Off. . | |
| 0208231 | 1/1987 | European Pat. Off. . | |
| 240360 | 10/1986 | Japan | 15/20 |
| 240369 | 10/1986 | Japan | 15/20 |
| 172493 | 7/1987 | Japan . | |
| 2173738A | 4/1985 | United Kingdom . | |

*Primary Examiner*—Harold Pitts

*Attorney, Agent, or Firm*—Charles R. Malandra, Jr.; Melvin J. Scolnick; David E. Pitchenik

[57] ABSTRACT

A postage meter recharging system is provided wherein an authorized value card center maintains a customer account of available postage funds. Upon confirmation of a meter access code the value card center debits the customer account and authorizes issuance of an integrated circuit value card bearing in memory a meter combination code and an appropriate amount of postage meter funds. The value card is inserted into the value card read-write unit of a postage meter terminal and, upon confirmation of the proper meter combination code, transfers at least a portion of the postage meter funds from the value card to the postage meter vault.

17 Claims, 1 Drawing Sheet

POSTAGE METER VALUE CARD SYSTEM

This application is a continuation of application Ser. No. 07/153,398, filed Feb. 8, 1988, now abandoned.

TECHNICAL FIELD

The present invention relates to a postage meter recharging system and, more specifically, to a postage meter recharging system including a value-containing integrated circuit card.

BACKGROUND AND OBJECTS OF THE INVENTION

It is heretofore known to provide a Remote Meter Recharging System ("RMRS") for use with electronic postage meters, such as models 6500 and 6900 available from Pitney Bowes Inc., the assignee of the present application. In the RMRS system the postage meter vendor, e.g. Pitney Bowes Inc., is authorized to operate an RMRS center, where the postage meter customer maintains a customer account. In order to recharge a meter, the customer contacts the RMRS center by telephone to request a transfer of funds from the customer account at the RMRS center to the postage meter. The customer provides the postage meter identification number, the amount of postage requested, and a meter access code. The RMRS center computes a RMRS key number and furnishes this number to the customer, who keys this number into the meter. The meter also computes a meter key number and compares the RMRS key number and the meter key number. If the numbers match, the meter vault will be refilled with the requested amount of funds up to the RMRS center account balance.

A system for controlling a network of postage meters is disclosed in the European Patent Application No. 86108929.0 of SMH Alcatel Ltd. entitled "Process and System for Controlling Postage Meters," published Jan. 7, 1987 under publication No. 0,207,492. Similar systems are apparently disclosed in Japanese Patent Disclosure No. 172493/1987 entitled "Mail Charge Processing Apparatus" filed in the name of Nippon Signal Co. Ltd. and U.K. Patent No. 2,173,738 entitled "Secure Transport of Information Between Electronic Stations" filed in the name of Roneo Alcatel Ltd. The system there disclosed apparently requires a complete transfer of the postage meter vault, i.e., the ascending and descending registers, to an integrated circuit card. To use a postage meter under the SMH Alcatel system an integrated circuit card must be disposed in the postage meter so that postage may be charged back to a fixed logic array on the card. In the absence of a card, the SMH Alcatel postage meter cannot be accessed. Accordingly, the SMH Alcatel system requires that the meter vault be transferred to the integrated circuit card. In the presently existing federal regulatory climate approval of such a system is questionable. Similar systems are apparently disclosed in Japanese Patent Disclosure No. 172493/1987 entitled "Mail Charge Processing Apparatus" filed in the name of Nippon Signal Co. Ltd. and U.K. Patent No. 2,173,738 entitled "Secure Transport of Information Between Electronic Stations" filed in the name of Roneo Alcatel Ltd.

U.S. Pat. No. 4,218,011 issued to Simjian entitled "Coupon Controlled Metering Device" discloses a single use coded coupon for updating a postage meter register. A similar magnetic card system having audit functions is disclosed in U.S. Pat. No. 4,629,871 entitled "Electronic Postage Meter System Settable by Means of a Remotely Generated Input Device."

It is one objective of the present invention to provide secure transfer of funds from an authorized center to a postage meter at the customer's premises.

It is a further object of the present invention to provide secure transfer of postal funds to a postage meter without removing the vault from the postage meter to the transfer medium.

These and other highly desirable objects and advantages are obtained in a convenient yet secure postage meter recharging system in accordance with the invention.

Objects and advantages of the invention are set forth in part herein and in part will be obvious herefrom, or may be learned by practice with the invention, the same being realized and attained by means of the instrumentalities and combinations pointed out in the appended claims.

SUMMARY OF THE INVENTION

In accordance with the present invention a postage meter recharging system is provided. The system includes a value card center analogous to currently established RMRS centers, one or more integrated circuit value cards (so-called "smart" cards), and a postage meter terminal associated with an electronic postage meter to be recharged.

The value card center is an authorized funds center for distributing postal funds. A customer maintains an account at the value card center and, as needed, requests transfer of funds to one or more postage meters located on the customer's premises. The customer's request for funds includes identification of the appropriate postage meter number, the amount of postal funds requested, and a meter access code. Upon confirmation of the meter access code the value card center debits the customer's account by the requested amount and authorizes issuance of an integrated circuit card or paper card bearing the requested amount of funds encoded therein. The value card center also generates a combination code and encodes this number into the value card.

So charged and encoded, the value card is provided to the customer for insertion into the postage meter terminal in secure communication with the meter in order to be charged. Upon confirmation of meter readiness and receipt of the combination code, at least a portion of the postal funds contained in the value card are transferred to the meter in order to charge the postage meter vault.

Of course, it is also contemplated that the value card center could issue value cards of fixed denomination. It is further contemplated that, upon proper authorization, the value card center could debit the requested postal funds directly to a customer bank account rather than maintaining customer account balances.

Thus, the postage meter recharging system in accordance with the present invention advantageously provides secure postage meter recharging in a convenient, readily acceptable manner without removing the vault from the postage meter. As a further advantage of the present invention wherein the vault remains within the meter, the present recharging system can be retro-fitted to many electronic postage meters already in the field.

It will be understood that the foregoing general description and the following detailed description as well are exemplary and explanatory of the invention but are not restrictive thereof.

BRIEF DESCRIPTION OF THE DRAWING

The accompanying drawing labeled as FIG. 1, referred to herein and constituting a part hereof, illustrates in schematic block diagram form the preferred embodiment of the present invention.

DETAILED DESCRIPTION OF THE PREFERRED EMBODIMENT

Figure 1:
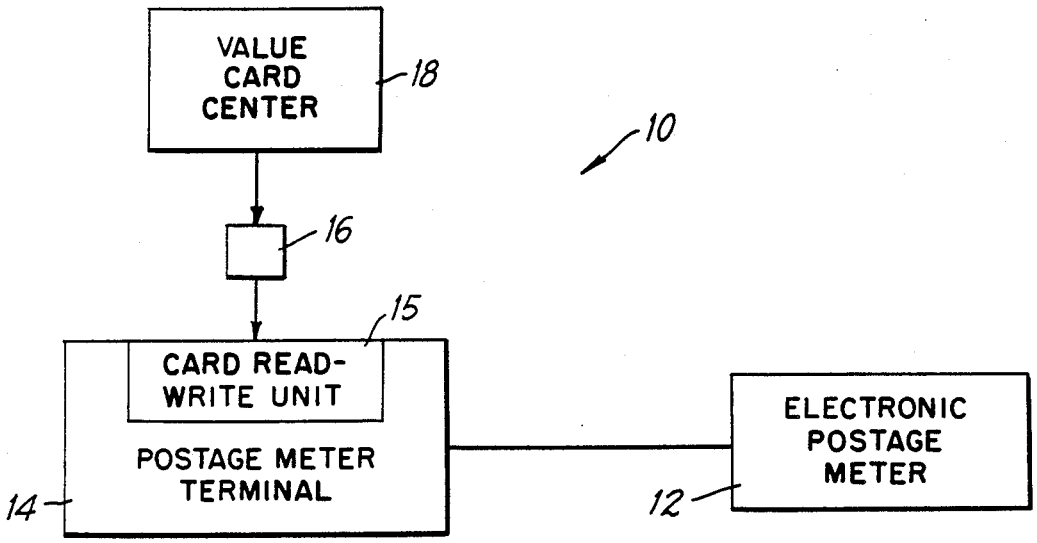

Referring now to the drawing, labeled as FIG. 1, there is shown in block diagram form the postage meter recharging system 10 in accordance with the invention. The system includes at least one electronic postage meter 12 securely connected to a postage meter terminal 14 adapted to receive an integrated circuit value card 16 having a microprocessor and memory, or memory only, commonly referred to as a "smart" card. A value card center 18 maintains customer accounts and, upon request, issues one or more value cards 16 bearing postage funds encoded therein.

Postage meter 12 may, for example, be either of electronic postage meter model nos. 6500 or 6900 available from Pitney Bowes Inc., assignee of the present application. Postage meter 12 is electronically connected to a postage meter terminal 14 so that postage meter 12 and terminal 14 interface in a known manner.

User terminal 14 includes an integrated circuit card read-write unit 15 for receiving and communicating with an integrated circuit value card 16 inserted therein. User terminal 14 is capable of communicating with both an integrated circuit card inserted into the integrated circuit read-write unit and with the electronic postage meter 12, effectively acting as an interface between meter 12 and card 16. Appropriate user terminal design, construction and programming is believed to be within the skill in the art based upon availability of appropriate smart card read-write units from the particular smart card manufacturer and predetermined meter protocol.

The preferred integrated circuit card is a non-contact integrated circuit card available from General Electric Corporation such as, for example, model GEC CT-30. Advantageously, the General Electric card may be programmed to include security features desired with the present invention to ensure secure funds transfer. In the preferred embodiment of the invention it is contemplated that the value card would be programmed to include the value card serial number, the date of manufacture, a meter combination code, a postage funds recharge amount and an end of entry code.

The value card center, as presently contemplated, would operate in a manner similar to the presently existing RMRS center. That is, the value card center would be an authorized funds source established and maintained by the postage meter vendor with the customer maintaining one or more monetary accounts at the center against which requests for postage meter funds would be charged. Of course, it is contemplated that the value card center could, alternatively and upon proper authorization, charge requests for postage meter funds directly to the customer's bank account. As with the RMRS systems, the customer request for funds would include identification by serial number of the postage meter to be recharged, the amount of postal funds requested, and the meter access code. As with RMRS, the request could be made by telephone. The value card center would confirm that the requested amount of postage funds are available from the customer's account, debit the requested amount of funds to the customer account, compute the combination code in the same manner as the RMRS center, and program the value card. As stated, the value card is programmed to include in memory the value card serial number and date of manufacture, the postage meter combination code, the amount of postage funds, and an end of entry code. Of course, it is contemplated that for convenience value cards could be prepared bearing predetermined amounts of funds.

The value card prepared in this manner is transmitted to the customer for meter recharging. The customer inserts the value card into meter terminal 14 which reads the card and communicates with meter 12. The value card first inquires as to meter status in order to confirm that the meter is ready to be recharged. Upon confirmation of meter readiness, the value card transmits a request for the meter combination code and awaits a valid response. After the proper confirmation code is received, the value card transmits a request for identification of the amount of funds to be transferred from the card to the meter. The requested amount of funds, up to the amount stored on the value card, is then transmitted via terminal 14 to meter 12 to update and recharge the meter vault. Thereafter, the card transmits the end of entry code to terminate communication between the card and meter. The value card is then removed from terminal 14 and the recharged meter is operated in the traditional fashion. Should any funds remain stored in the value card the card can be reinserted into the terminal read-write unit on one or more subsequent occasions to complete the transfer of funds to the meter. Of course, it is contemplated that the value card could alternatively be programmed to automatically transfer all available postal funds upon receipt of a proper combination code. Once the value card has been exhausted the customer may either dispose of the card or return it to the value card center.

It will readily be appreciated that the postage meter recharging system in accordance with the present invention advantageously provides a safe, convenient method of recharging electronic postage meters in a manner complimentary to the existing Remote Meter Recharging System. As such, the system according to the present invention remarkably may be retro-fitted to electronic postage meters existing in the field without modification. In this regard, since the postage funds vault remains at all times within the postage meter the system according to the present invention should find favor with federal regulatory authorities.

To the extent not already indicated, it will be understood that the invention in its broader aspects is not limited to the specific embodiments herein shown and described but departures may be made therefrom within the scope of the accompanying claims, without departing from the principles of the invention and without sacrificing its chief advantages.

What is claimed is:

1. A postage meter recharging system comprising:

a card center for receiving funds from a customer and issuing a card means bearing postage funds encoded therein; and postage meter terminal means connected to at least one postage meter for transferring at least a portion of said postage funds from said card means to the postage meter vault.

2. The postage meter recharging system according to claim 1 wherein said card center receives a request for said postage funds from a customer, said request including serial number of said postage meter, amount of postal funds requested, and customer access code, said card center confirming said customer access code, debiting said amount of postal funds to customer's account, and authorizing issuance of said card means bearing said postage funds.

3. The postage meter recharging system according to claim 2 wherein said card means is programmed to include a card serial number, date of card manufacture, a meter combination code, said postage funds, and an end of entry code.

4. The postage meter recharging system according to claim 3 wherein said card means, upon being inserted into said postage meter terminal means, (i) confirms meter readiness for recharging;
(ii) upon confirmation of said meter readiness requests said meter combination code from said postage meter;
(iii) upon receipt of said meter combination code from said postage meter transmits at least a portion of said postage funds to said postage meter vault; and
(iv) upon confirmation of said recharging of said postage meter vault transmits said end of entry code.

5. The postage meter recharging system according to claim 3 wherein said card means, upon being inserted into said postage meter terminal means, (i) confirms meter readiness for recharging;
(ii) upon confirmation of said meter readiness requests said meter combination code from said postage meter;
(iii) upon confirmation of said meter combination code requests identification of an amount of said postage funds to be transferred from said card means to said postage meter;
(iv) transmits said requested amount of said postage funds to said postage meter vault; and
(v) upon confirmation of said recharging of said postage meter vault transmits said end of entry code, whereupon said card means may be removed from said postage meter terminal means.

6. The postage meter recharging system according to claim 5 wherein said card means is subsequently reinserted into said postage meter terminal means to transfer at least a portion of any remaining postage funds from said card means to said postage meter vault.

7. A postage meter recharging system comprising:

(a) at least one electronic postage meter;
(b) a value card means having a microprocessor which is programmed for controlling the recharging of said postage meter;
(c) card center means for receiving payment funds from a customer and issuing said value card means bearing postage funds encoded therein; and
(d) postage meter terminal means having a value card read-write means connected to said postage meter for transferring at least a portion of said postage funds from said value card means to a vault in said postage meter.

8. The postage meter recharging system according to claim 7 wherein said card center receives a request for said postage funds from a customer, said request including serial number of said postage meter, amount of postal funds requested, and customer access code, said card center confirming said customer access code, debiting said amount of postal funds to customer's account, and authorizing issuance of said card means bearing said postage funds.

9. The postage meter recharging system according to claim 8 wherein said card means is programmed to include a card serial number, date of card manufacture, a meter combination code, said postage funds, and an end of entry code.

10. The postage meter recharging system according to claim 9 wherein said card means, upon being inserted into said postage meter terminal means, (i) confirms meter readiness for recharging;
(ii) upon confirmation of said meter readiness requests said meter combination code from said postage meter;
(iii) upon receipt of said meter combination code from said postage meter transmits at least a portion of said postage funds to said postage meter vault; and
(iv) upon confirmation of said recharging of said postage meter vault transmits said end of entry code.

11. The postage meter recharging system according to claim 9 wherein said card means, upon being inserted into said postage meter terminal means, (i) confirms meter readiness for recharging;
(ii) upon confirmation of said meter readiness requests said meter combination code from said postage meter;
(iii) upon confirmation of said meter combination code requests identification of an amount of said postage funds to be transferred from said card means to said postage meter;
(iv) transmits said requested amount of postage funds to said postage meter vault; and
(v) upon confirmation of said recharging of said postage meter vault transmits said end of entry code, whereupon said card means may be removed from said postage meter terminal means.

12. The postage meter recharging system according to claim 11 wherein said card means is subsequently reinserted into said postage meter terminal means to transfer at least a portion of any remaining postage funds from said card means to said postage meter vault.

13. The postage meter recharging system according to claim 6 wherein said meter was previously in use and said postage meter terminal means has been connected to said meter through a communication link, and said card center means and said card means have been added to form the system.

14. The postage meter recharging system according to claim 12 wherein said meter was previously in use and said postage meter terminal means, said value card means and said card center means have been retrofitted to form the system by connecting said postage meter terminal means to said meter through a communication link.

15. A postage meter recharging system comprising:

(a) at least one electronic postage meter having a postage meter vault;
(b) postage meter terminal means connected to said postage meter;
(c) said postage meter terminal means being operated to receive card means bearing postage meter funds thereon; and (d) said postage meter terminal means further being operated to transfer at least a portion of said postage meter funds to said postage meter vault inserting an integrated circuit card bearing postage meter funds into a postage meter terminal coupled to the postage meter;

operating said postage meter terminal to accomplish a transfer of at least a portion of said postage meter funds from said card to the postage meter;

confirming said transfer was completed; and withdrawing said card from said postage meter terminal, said card bearing a remaining portion of said postage funds which were not transferred.

16. A method of recharging a postage meter according to claim 15 further comprising the step of:

prior to inserting said card, paying at a card center an amount equal to said postage funds and issuing at said card center said card bearing said postage funds.

17. A method of recharging a postage meter according to claim 16 further comprising the step of:

controlling said transfer of postage funds by said card, said card having a microprocessor to control said transfer.

* * * * *